US011142393B2

(12) United States Patent
Dogan et al.

(10) Patent No.: US 11,142,393 B2
(45) Date of Patent: Oct. 12, 2021

(54) COFFEE CAPSULE FOR PREPARING TURKISH COFFEE

(71) Applicant: NESTEC S.A., Vevey (CH)

(72) Inventors: Nihan Dogan, La-Croix-sur-Lutry (CH); Baptiste Billot, Les Hopitaux Neufs (FR)

(73) Assignee: Societe des Produits Nestle S.A., Vevey (CH)

( * ) Notice: Subject to any disclaimer, the term of this patent is extended or adjusted under 35 U.S.C. 154(b) by 38 days.

(21) Appl. No.: 16/316,430

(22) PCT Filed: Jul. 13, 2017

(86) PCT No.: PCT/EP2017/067661
§ 371 (c)(1),
(2) Date: Jan. 9, 2019

(87) PCT Pub. No.: WO2018/011328
PCT Pub. Date: Jan. 18, 2018

(65) Prior Publication Data

US 2019/0225413 A1 Jul. 25, 2019

(30) Foreign Application Priority Data

Jul. 14, 2016 (EP) ..... 16179562

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

| | | | | |
|---|---|---|---|---|
| 2006/0219098 | A1* | 10/2006 | Mandralis | B65D 85/8043 99/279 |
| 2009/0211458 | A1* | 8/2009 | Denisart | B65D 85/8043 99/300 |
| 2010/0034929 | A1* | 2/2010 | Dogan | B65D 85/8043 426/89 |
| 2012/0301581 | A1* | 11/2012 | Abegglen | B65D 85/8043 426/112 |

FOREIGN PATENT DOCUMENTS

| | | | |
|---|---|---|---|
| WO | 2007136958 | 11/2007 | |
| WO | 2009115475 | 9/2009 | |
| WO | 2011159162 | 12/2011 | |
| WO | 2012034819 A1 | 3/2012 | |
| WO | 2012144885 | 10/2012 | |
| WO | WO-2014037339 A1 * | 3/2014 | B65D 65/38 |
| WO | 2014167062 | 10/2014 | |

* cited by examiner

*Primary Examiner* — Viren A Thakur
*Assistant Examiner* — Thanh H Nguyen
(74) *Attorney, Agent, or Firm* — K&L Gates LLP

(57) ABSTRACT

The present invention relates to a capsule for preparation of a specific coffee beverage and in particular a Turkish coffee.

13 Claims, 2 Drawing Sheets

COFFEE CAPSULE FOR PREPARING TURKISH COFFEE

CROSS REFERENCE TO RELATED APPLICATIONS

The present application is a National Stage of International Application No. PCT/EP2017/067661, filed on Jul. 13, 2017, which claims priority to European Application No. 16179562.0, filed on Jul. 14, 2016, the entire contents of which are being incorporated herein by reference.

FIELD OF THE INVENTION

The present invention relates to a capsule for preparation of a specific coffee beverage and in particular a Turkish coffee.

BACKGROUND OF THE INVENTION

Capsules for preparation of a food product such as a coffee beverage are widely known in the market. An example of such capsule that is intended for being used with a beverage preparation machine is described in EP 0 512 468 A1. Thereby, beverage ingredients provided in the capsule are made to interact with liquid provided to the capsule in order to form a desired beverage that is then made to leave the capsule. The described capsule is opened under the effect of rising pressure within the capsule and which urges an outlet face of the capsule against opening means such as raised elements provided on a supporting part of the beverage preparation machine. Thereby, the machine-based opening means come into contact with the beverage delivered from the capsule which makes it difficult for contamination and taste reasons, to envisage extracting with this system capsules containing substances other than roasted ground coffee, because of beverage residue present on the supporting part.

EP 1 472 156 A1 aims at providing a solution to this problem by means of a capsule comprising self-opening means which enable the opening of an outlet of the capsule due to increase of pressure within a beverage ingredients containing chamber of the capsule. In particular, upon introduction of liquid via a top membrane, the rise in pressure within the beverage ingredient chamber will press a lower thin film arranged at the outlet area of the capsule against raised and recessed elements situated in a bottom portion of the capsule so as to open the said thin film and enable the beverage to flow out from the capsule and directly into a mug arranged beneath without contacting a portion of the beverage preparation machine.

In view of the increasing popularity of these machines, there is a growing demand for enabling the preparation of individual coffee specialties such as e.g. Turkish coffee in a convenient manner. This is in particular the case as the traditional preparation of Turkish coffee is quite cumbersome and requires for a couple of preparation steps such as grinding or pounding coffee beans to the finest possible powder, immersing the coffee grounds in hot but yet not boiling water within a dedicated pot, stirring the coffee and a preferred amount of sugar until all coffee particles sink, putting the pot on moderate heat for simmering (not boiling) the coffee and removing the pot from the heat upon the start of boiling of the coffee for a short time. The coffee in the pot may be brought to boil a second and third time before pouring the coffee into the cups. The resulting coffee beverage has a layer of dark crema and contains fine coffee particles in the coffee cup.

The known coffee capsules do not enable the preparation of a beverage which resembles a Turkish coffee in particular as the known capsules do not provide for the characteristic dark crema and the fine particles sediment within the cup. Furthermore, the known coffee capsules are designed for preparing a coffee beverage from water being injected at relatively large pressure into the capsule and for creating a relatively large pressure drop within the capsule. A relatively longer interaction time of water and the coffee particles in the capsule and a relatively low pressure drop which is required for the characteristic taste of Turkish coffee cannot be obtained with the known coffee capsules and the beverage preparation machines for being used therewith.

In addition, the current high pressure capsules provide for a filtering effect at the capsule in order to create back-pressure in the capsule. Therefore, these capsules do not let the coffee particles to pass to the coffee cup. This is however very important for Turkish coffee crema and taste to have such coffee particles passing into the cup, at least for some of them, which deposit into the cup as a bottom layer.

Therefore, the present invention seeks to provide an enhanced coffee capsule which solves these problems and which is designed for providing a resulting coffee beverage resembling a coffee prepared according to the traditional manual Turkish coffee preparation process while at the same time enabling a very convenient and clean beverage preparation process. Thereby, the capsule is preferably designed for being used with the known beverage preparation machines without requiring an adaption of the machine related functions.

This object is solved by the independent claim. The dependent claims define further preferred embodiments of the invention.

SUMMARY OF THE INVENTION

The invention relates to a capsule designed for preparation of a beverage, particularly a Turkish coffee, upon injection of liquid under pressure into the capsule, the capsule containing a substance for preparation of the beverage and comprising a cup-shaped body, a top wall and a bottom retaining wall, wherein the capsule further comprises opening means designed to open the retaining wall upon rise in pressure in the capsule, wherein the opening means comprise a plurality of first elements and associated secondary elements facing the retaining wall, the secondary elements surrounding at least partially the respective first element and being arranged adjacent to but not in contact with the respective first element, the first elements being non-linear elements, preferably Y-shaped elements, and the secondary elements being linear elements, wherein the secondary elements are arranged at larger distance to the retaining wall than the first elements, wherein the retaining wall is a thin film having a thickness of between 15 and 25 microns, wherein the capsule further comprises a series of dispensing holes having a diameter of at least 0.4 mm, preferably at least 0.5 mm, and wherein the substance is a precursor ingredient of roast and finely ground coffee.

The capsule as proposed herewith enables the preparation of a coffee beverage resembling the result of a Traditional Turkish coffee beverage preparation process upon injection of liquid, preferably water with the known prior art machines. Thereby, the proposed design of the capsule enables an effective balancing of the required small pressure drop within the capsule during beverage preparation and the interaction time between coffee and water required for taste. In particular, the non-linear, preferably Y-shaped elements ensure that the retaining wall opens widely upon raise in pressure in the capsule, i.e. by creating relatively large openings in the retaining wall, but which do not propagate too much as the propagation of the openings is stopped by the associated secondary elements that are arranged at a larger distance to the retaining wall. The length of the created openings in the retaining wall is preferably between 3-10 mm. The respective openings preferably extend from each non-linear respectively Y-shaped element to at least one of the respective associated secondary elements. Due to the relatively large openings created in the retaining wall during beverage preparation, a low extraction pressure of between 1.0 to 2.0 bar, preferably about 1.5 bar is obtained, which significantly differs from prior art capsules in which a pressure of between 6-12 bars is present during the beverage injection process.

The capsule according to the invention is preferably designed for being used with a known capsule-based prior art beverage preparation machine which is equipped with a liquid supply circuit comprising a pump and/or heating means and which may selectively perforate respectively pierce the top wall of the capsule by a dedicated injection element such as a hollow needle in order to inject heated and/or pressurized liquid into the capsule.

The opening means are preferably situated outside of a closed chamber of the capsule for holding the substance for preparing the beverage. The closed chamber may be formed by the top wall, at least a portion of the cup-shaped body and by the retaining wall. As a preference, the opening means are situated below the retaining wall and/or are at least in part in contact therewith. The opening of the capsule is achieved by relative engagement of the opening means with the bottom retaining wall. The relative engagement of the opening means and of the retaining wall is preferably performed under the effect of rise in pressure of liquid provided to the capsule. In particular, upon injection of liquid to the capsule respectively to a closed chamber thereof, the bottom retaining wall is moved under the effect of the rise in pressure against the opening means who will perforate or tear at least a portion of the bottom retaining wall in order to create holes or apertures therein. The creation of holes or apertures in the retaining wall is however not limited to an active perforation or tearing by the openings means but may as well be due to the retaining wall reaching its breaking stress upon contact with at least part of the opening means.

The beverage substance may be held within the above-described closed chamber of the capsule or within a dedicated compartment thereof. The capsule may comprise a flow distribution means such as a plate with openings which divides the closed chamber of the capsule in at least a first and second compartment. The beverage substance may be held within at least one of the provided compartments of the capsule.

The capsule preferably further comprises outlet means which are arranged below the opening means and which are preferably designed for collecting the resulting beverage and dispense it from a lower portion of the capsule body.

The retaining wall preferably has a thickness of between 18 and 23 microns, more preferably 20 microns. The retaining wall is preferably made from aluminum, but may as well be made of plastic and/or a composite material. Due to the relatively low thickness thin film, the capsule is designed to open at a relatively low pressure, so that the pressure within the capsule does not increase too much in order to ensure a low-pressure extraction of the beverage substance. The retaining wall may be connected such as e.g. by welding or gluing to an inner annular portion of the cup-shaped body of the capsule.

The top wall of the capsule is preferably a thin film able to be perforated by a dedicated opening and/or injection member of a beverage preparation machine for being used with the capsule. The top wall preferably comprises a thickness of between 20 and 300 microns. The top wall is preferably made from aluminum but may as well be made of plastic and/or a composite material. The top wall is preferably connected to the cup-shaped body of the capsule and more preferred to a flange-like rim extending from the cup-shaped body. The top wall is preferably connected to the cup-shaped body by welding or gluing.

Both the top wall and the retaining wall are preferably made from a material comprising oxygen and moisture barrier properties. Accordingly, the top wall and the retaining wall together with the capsule body provide a closed or sealed capsule for enclosing the beverage ingredients therein.

The cup shaped body of the capsule is preferably made from plastic material formed by an injection molding process. The cup-shaped body may as well be made of composite material comprising further materials and/or layers such as in particular additional barrier layers.

The respective first element of the opening means is preferably a singular element that is surrounded by the respective associated secondary elements. The respective first and associated secondary elements are preferably arranged adjacent to each other, i.e. in close vicinity to each other, but do not contact each other. Accordingly, the respective first and associated secondary elements are preferably distinct elements that are separated from each other. Thereby, the first and secondary elements may protrude from a common surface. The first element is preferably of essentially Y-shaped form when seen in top view. The first element may be however of different non-linear shape when seen in top view such as in particular of X- or star-shaped form.

The secondary elements preferably each comprise at least two, preferably three linear segments when seen in top view, and which are arranged to at least partially surround the respective first element when seen in top view. In a preferred embodiment, at least two linear segments of the secondary elements are arranged at medium distance to the retaining wall and one segment is arranged at a relatively larger distance to the retaining wall. The respective linear segment of relatively larger distance to the retaining wall is preferably arranged radially outwards with respect to the respective first element.

The distance of the respective first element to the retaining wall lies between 0 to 0.2 mm. In a preferred embodiment, the respective first element is arranged to abut at the retaining wall of the capsule. In particular, an upper planar front face thereof is preferably arranged to abut at the retaining wall.

The secondary elements are arranged at a distance to the retaining wall which lies between 0.5 mm to 1.2 mm. Thereby, the distance of the at least two linear segments of medium distance to the retaining wall is preferably constant and lies between 0.5 and 0.7 mm. The distance of the third linear segment to the retaining wall is preferably between 1 to 1.2 mm.

The associated first and secondary elements are preferably homogenously arranged with respect to the circumference of the retaining wall.

The opening means preferably comprise third linear elements arranged to radially extend between the respective associated first and secondary elements. The third linear elements are preferably arranged at the same distance to the retaining wall as the at least two linear segments of the secondary elements which are arranged at medium distance to the retaining wall.

In a preferred embodiment, the opening means are arranged in a bottom portion of the capsule. For example, the capsule may comprise an opening plate of preferably disc-shaped form and from which the opening means protrude. The opening plate may be arranged within the bottom portion of the capsule. The opening means may as well be presented by raised and recessed elements of the opening plate and/or arranged in the bottom portion of the capsule. The opening plate is preferably rotational symmetric. The opening plate is preferably an integrally formed part that may be made from plastic material e.g. by means of an injection molding process. In an alternative embodiment, the opening means may be integrally formed with the bottom portion of the capsule.

The capsule comprises a series of evacuating dispensing holes for evacuating the resulting beverage from the capsule. The dispensing holes may be provided in the bottom portion of the capsule and/or in the opening plate arranged therein. The dispensing holes are preferably arranged at least at an outer periphery of the opening means. The dispensing holes preferably comprise a diameter of between 0.4 to 1 mm, preferably between 0.5 and 0.9 mm. The relatively large dispensing holes enable the passage of fine particles from the beverage substance held in the capsule, which are thus delivered to the cup and which provide a dark crema and a layer of particles at the bottom of the beverage cup.

The capsule preferably comprises a plurality of inner and outer dispensing holes, wherein the inner holes are arranged radially inwards of the outer holes and wherein the outer holes have a relatively larger diameter.

The substance for preparation of the beverage is preferably a precursor for Turkish coffee and comprises roast and ground coffee powder being a light-roasted and very finely ground coffee. The substance preferably comprises an average particle size between 100 to 330, more preferably between 110 to 150 microns (d50 value). The substance is preferably provided in an amount for enabling the preparation of a Turkish coffee of between 25 to 70 ml. The capsule preferably comprises between 1.5 to 8 grams, preferably between 5 and 6 grams of beverage substance. In a particularly preferred embodiment, the capsule comprises about 4 grams of beverage substance for 40 ml preparation size.

The beverage substance may additionally comprise a portion of soluble coffee which is either mixed with a portion of ground coffee or which may be provided in a dedicated separate compartment of the capsule. The respective compartments may be divided by a flow distribution member comprising a plurality of openings and which enables the fluid communication from a first to a second compartment. In a preferred embodiment, the capsule comprises between 0.2 to 1 grams of soluble coffee in addition to the above indicated amount of ground coffee.

In a further aspect, the invention relates to the use of the capsule as described here-above for preparing a coffee beverage, preferably a Turkish coffee beverage upon injection of liquid. Thereby, heated and/or pressurized liquid is preferably injected into the capsule. The liquid may be injected into the capsule at a pressure of between 1.5 to 8 bars.

BRIEF DESCRIPTION OF THE DRAWINGS

Further features, advantages and objects of the present invention will become apparent for a skilled person when reading the following detailed description of embodiments of the present invention, when taken in conjunction with the figures of the enclosed drawings.

DETAILED DESCRIPTION OF THE INVENTION

Figure 1:
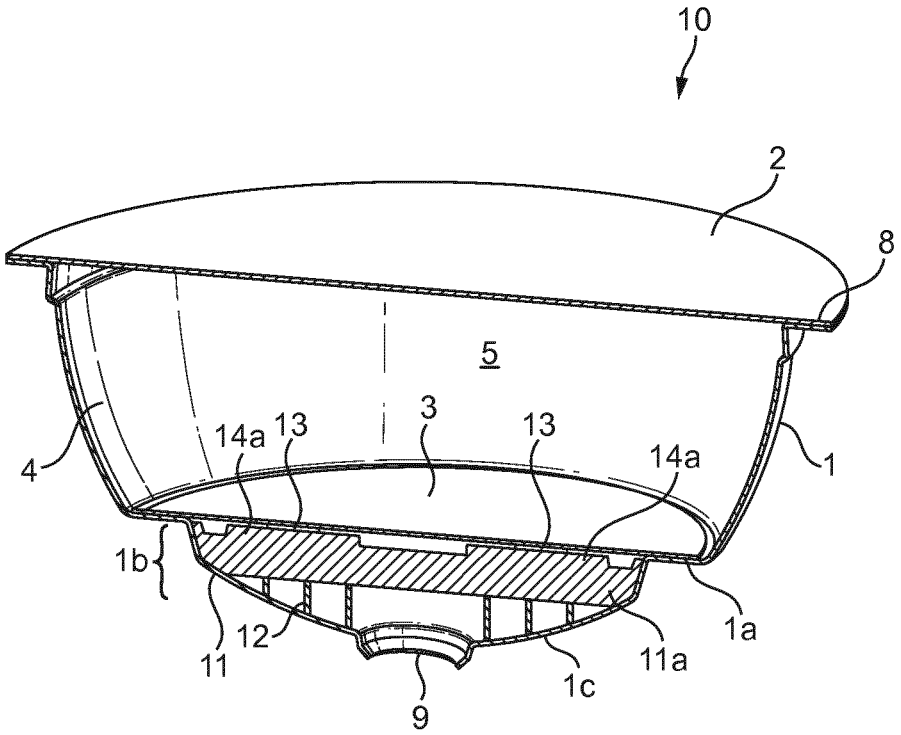
FIG. 1 is a perspective cross-sectional side view of a preferred embodiment of the capsule according to the invention.

FIG. 1 shows a preferred embodiment of the capsule 10 according to the invention, the capsule 10 comprising a cup-shaped body 1, a top wall 2 and a bottom retaining wall 3. The cup-shaped body 1 is preferably rotational symmetric and made of a single injection molded piece. At a lower bottom portion 1*b*, the cup-shaped body 1 preferably comprises a recess 1*c* for housing opening means 11 of the capsule 10. At a center of the bottom portion 1*b*, the capsule preferably comprises an outlet duct 9. A retaining wall 3 of the capsule 10 is preferably arranged such as to cover the opening means 11. Thereby, the retaining wall 3 is preferably connected to an annular portion 1*a* provided at a lower portion of the capsule. The retaining wall 3 is preferably arranged such as to contact at least part of the opening means 11.

The top wall 2, the retaining wall 3 and the sidewalls of the cup-shaped body 1 preferably enclose a closed chamber 4 for holding a beverage substance 5 from which a beverage may be prepared upon interaction with liquid provided into the capsule.

The opening means 11 preferably comprise an opening plate 11*a*, which is preferably made from a single injection molded piece and which is housed in the dedicated recess 1*c* of the capsule 10. The opening plate 11*a* is preferably of essentially disc-shaped form and comprises first elements 13 and secondary elements 14*a*, 14*b*, 14*c* which will be described further below with respect to FIG. 3. In the preferred embodiment as shown in FIG. 1, at least the first elements 13 of the opening means 11 are in contact with the retaining wall 3, in particular with a lower surface of the retaining wall 3, whereas the secondary elements 14*a*, 14*b*, 14*c* are arranged at a distant to the retaining wall 3. It is to be understood that the opening means 11, in particular the first and secondary elements 13, 14*a*, 14*b*, 14*c* may as well be integrally formed in a bottom portion 1*b* of the capsule, i.e. without the provision of a dedicated opening plate 11*a*.

The opening plate 11*a* is preferably arranged essentially in parallel to the retaining wall 3. The opening plate 11*a* may further comprise support ribs 12 which protrude from a lower surface of the opening plate 11*a* and which position the plate 11*a* within the recess 1*c* of the capsule 10. The ribs 12 are preferably arranged off-set to each other and/or may comprise dedicated recesses for enabling a liquid flow from below the retaining wall 3 to the outlet 9 of the capsule 10.

Figure 2:
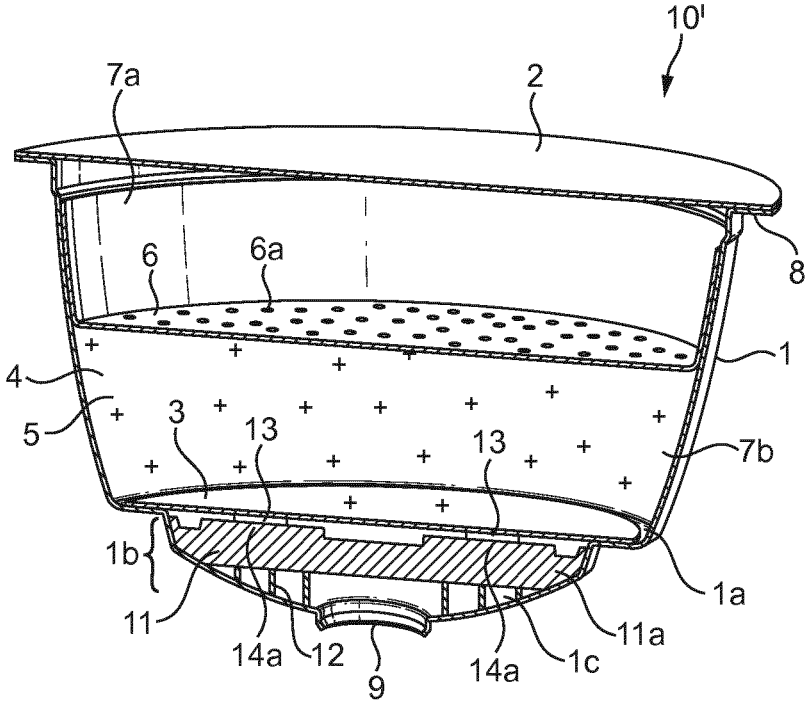
FIG. 2 is perspective cross-sectional side view of a variant of the capsule according to FIG. 1.

FIG. 2 shows an alternative embodiment of the capsule 10' according to the invention and wherein the capsule further comprises a flow distribution means 6. The flow distribution means 6 may be in the form of an essentially horizontal plate with openings 6*a* and which divides the closed chamber 4 of the capsule in at least a first and second compartment 7*a*, 7*b*. In the embodiment as shown in FIG. 2, only the second compartment 7*b* contains a beverage substance 5. It is however as well viable that the first compartment 7*a* also contains a beverage substance, which either equals the substance held in the second compartment 7*b* or differs in type and/or particle size. The capsule 10' may as well comprise two flow distribution means (not shown) which may be arranged essentially in parallel and which thus divide the capsule in a first, second and third compartment. Thereby, at least the lower two compartments may contain beverage substance which preferably differs in type and/or particle size. The openings 6*a* of the flow distribution means preferably have a diameter of between 0.5 to 1.5 mm and are preferably homogenously distributed about the surface of the distribution means 6.

Figure 3:
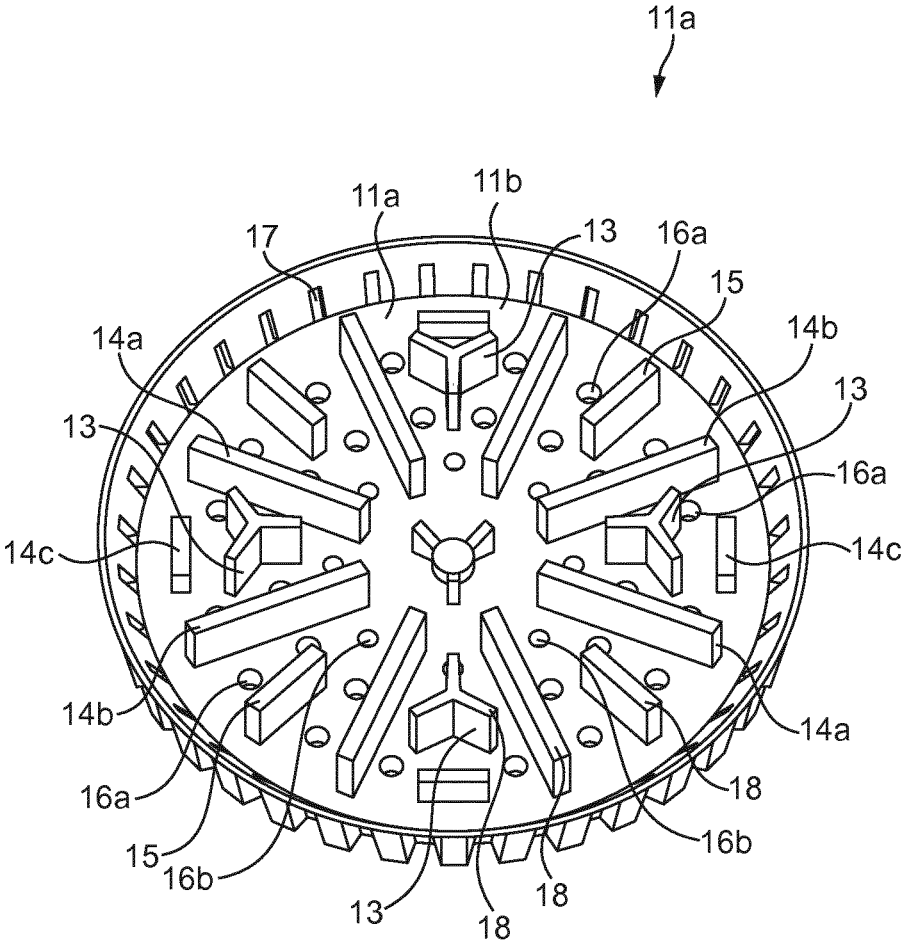
FIG. 3 is a perspective side view of a preferred embodiment of an opening plate comprising the opening means according to the invention.

FIG. 3 is a perspective side view of a preferred embodiment of the opening plate 11*a* comprising the opening means 11 according to the invention. The opening plate 11*a* comprises an upper surface 11*b* from which a plurality of elements protrude to predefined height.

The opening means 11 of the plate 11*a* comprise a plurality of first elements 13 and associated secondary elements 14*a*, 14*b*, and 14*c*. The first and secondary elements protrude from the upper surface 11*b* to a different height. The opening means 11 preferably comprise at least two, more preferably at least three respective first elements 13 and the respective associated secondary elements 14*a*, 14*b*, 14*c*. The first elements 13 and the associated secondary elements 14*a*, 14*b*, 14*c* are preferably homogenously distributed about the circumference of the opening plate 11*a*.

The first elements 13 are non-linear elements and are preferably of essentially Y-shaped form when seen in top view onto the plate 11*a*. The secondary elements 14*a*, 14*b*, 14*c* are essentially linearly extending elements when seen in top view onto the plate 11*a* and are arranged such as to at least in part surround the respective first elements 13.

The first elements 13 and the secondary elements 14*a*, 14*b*, 14*c* of the opening means 11 preferably each comprise a front face 18 that is preferably arranged essentially parallel to the retaining wall 3 and in particular to a lower surface thereof.

The respective secondary elements 14*a*, 14*b*, 14*c* are arranged at larger distance to the retaining wall 3 as indicated in FIGS. 1 and 2. The respective first elements 13 are thus preferably protruding to a larger height from the upper surface 11*b* of the opening plate 11*a* than the secondary elements 14*a*, 14*b*, and 14*c*. The respective first elements 13 are preferably protruding to the same height from the upper surface 11*b*, which preferably lies between 1.5 and 2.5 mm, and more preferably about 2 mm.

A respective first and second linear segment 14*a*, 14*b* of the secondary elements, which are preferably arranged to extend radially on the opening plate 11*a* comprises a height from the upper surface 11*b* which preferably lies between 1.2 and 1.7 mm, and more preferably about 1.5 mm.

A third linear segment 14*c* of the secondary elements, which is arranged radially outwards of the respective first element 13 preferably comprises a height from the upper surface 11*b* which lies between 0.7 and 1.3 mm, and more preferably about 1 mm.

The opening plate 11*b* preferably further comprises third linear elements 15 which are arranged to radially extend between the respective associated first and secondary elements 13, 14*a*, 14*b*, 14*c*. These third elements 15 preferably comprise a height from the upper surface 11*b* which lies between 1.2 and 1.7 mm, and more preferably about 1.5 mm.

The opening plate 11*b* preferably further comprises a plurality of evacuating dispensing through holes 16*a*, 16*b* with a diameter of between 0.4 to 1 mm, preferably between 0.5 and 0.9 mm. The dispensing through holes 16*a*, 16*b* are preferably arranged to surround the first and secondary elements 13, 14*a*, 14*b*, 14*c*. The dispensing through holes 16*a*, 16*b* may comprise inner through holes 16*b* and outer through holes 16*a*, wherein the inner through holes 16*b* are arranged radially inwards of the outer through holes 16*a*. The outer through holes 16*a* preferably have a relatively larger diameter. In a particularly preferred embodiment, the inner through holes 16*b* comprise a diameter of between 0.3 to 0.7, more preferably about 0.5 mm and the outer through holes 16*a* comprise a diameter of between 0.6 to 1 mm, more preferably about 0.8 mm.

The opening plate 11*b* preferably further comprises opening slots 17 at the circumference of the opening plate 11*b*. The slots 17 are preferably homogenously distributed about the circumference of the opening plate 11*b*.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule designed for preparation of a beverage upon injection of liquid under pressure into the capsule, the capsule containing a substance for the preparation of the beverage and comprising a cup-shaped body, a top wall and a bottom retaining wall, the capsule further comprises an opener designed to open the bottom retaining wall upon a rise in pressure in the capsule, the opener comprises a plurality of first elements and associated secondary elements facing the retaining wall, the first and secondary elements are homogenously arranged with respect to the circumference of the retaining wall, the secondary elements each surrounding at least partially a respective first element and being arranged adjacent to but not in contact with the respective first element, the first elements being non-linear elements, and the secondary elements being linear elements, the secondary elements are arranged at a larger distance to the retaining wall than the first elements, a distance of the first elements to the retaining wall is 0 to 0.2 mm, and a distance of the secondary elements to the retaining wall is 0.5 mm to 1.2 mm, the retaining wall is a thin film having a thickness of between 15 and 25 microns, the substance is a precursor ingredient of roast and ground coffee, and the substance has a particle size between 100 microns and 330 microns, the secondary elements each comprise three linear segments arranged to at least partially surround the respective first element, two of the three linear segments of each of the secondary elements are arranged at a first distance to the retaining wall, and one of the three linear segments of each of the secondary elements is arranged at a second distance to the retaining wall that is larger than the first distance, and the one of the three linear segments arranged at the second distance to the retaining wall is arranged radially outwards with respect to the respective first element; and the opener further comprises third linear elements arranged to radially extend between the associated first and secondary elements, and the opener is configured to create at least one opening having a diameter between 0.3 mm and 10 mm in the retaining wall, the capsule comprises a series of dispensing holes comprising a plurality of inner and outer dispensing holes, the inner dispensing holes are arranged radially inwards of the outer dispensing holes and each have a first diameter, and the outer dispensing holes each have a second diameter that is larger than the first diameter of the inner dispensing holes, wherein the first diameter is at least 0.4 mm, and the capsule comprises an opening plate that comprises the first and secondary elements and the series of dispensing holes.

2. The capsule according to claim 1, wherein the retaining wall is a thin film having a thickness of 20 microns.

3. The capsule according to claim 1, wherein the third linear elements are arranged at the same distance to the retaining wall as at least two of the linear segments of the secondary elements.

4. The capsule according to claim 1, wherein the opener is arranged in a bottom portion of the capsule.

5. The capsule according to claim 1, wherein the opening plate is in a bottom portion of the capsule, and the opener protrudes from the opening plate.

6. The capsule according to claim 1, wherein the second diameter is at most 1 mm.

7. The capsule according to claim 1, wherein the first elements each comprise an upper planar front face arranged to abut at the retaining wall.

8. The capsule according to claim 5, wherein the opening plate is rotationally symmetric.

9. The capsule according to claim 1, wherein the first elements each have a Y-shape.

10. The capsule according to claim 1, wherein a distance of the third linear elements to the retaining wall is 1.0 to 1.2 mm.

11. The capsule according to claim 1, wherein an amount of the roast and ground coffee in the capsule is between 1.5 grams and 8 grams.

12. The capsule according to claim 1, wherein the top wall has a thickness between 20 microns and 300 microns.

13. The capsule according to claim 1, wherein the opener is configured to open the retaining wall upon a rise in pressure of 1.0 to 2.0 bar.

* * * * *